US006694795B1

(12) United States Patent
Quinn

(10) Patent No.: US 6,694,795 B1
(45) Date of Patent: Feb. 24, 2004

(54) CRIMPING SYSTEM

(76) Inventor: Robert Quinn, 9771 Parkwood Ct., Largo, FL (US) 33777

( * ) Notice: Subject to any disclaimer, the term of this patent is extended or adjusted under 35 U.S.C. 154(b) by 38 days.

(21) Appl. No.: 09/910,229

(22) Filed: Jul. 20, 2001

(51) Int. Cl.[7] ..... B21J 13/10

(52) U.S. Cl. ..... 72/420; 72/20.2; 72/196; 72/409.06; 72/414; 72/712; 29/753

(58) Field of Search ..... 72/20.1, 20.2, 72/192, 196, 197, 385, 414, 409.06, 409.14, 420, 712; 29/753, 863

(56) References Cited

U.S. PATENT DOCUMENTS 3,350,765 A * 11/1967 Karl ..... 29/753
3,628,228 A * 12/1971 Van De Kerhof ..... 29/56.06
3,766,625 A * 10/1973 Wagner ..... 29/753
3,813,753 A * 6/1974 Mille ..... 29/753
3,861,017 A * 1/1975 Garfinkel et al. ..... 29/753
3,911,712 A * 10/1975 Wustinger et al. ..... 72/324
3,911,717 A * 10/1975 Yuda ..... 72/331
3,911,721 A * 10/1975 Baldyga ..... 72/441
5,490,406 A * 2/1996 College ..... 72/30.1
5,661,897 A * 9/1997 Kaneda et al. ..... 29/753
6,073,471 A * 6/2000 Naka et al. ..... 72/21.3

* cited by examiner

*Primary Examiner*—Ed Tolan
(74) *Attorney, Agent, or Firm*—Edward P. Dutkiewicz

(57) ABSTRACT

A crimping system comprises a frame having a plurality of plates with a clamp adjacent to the lower end. Applicator mechanisms are adapted to feed crimpable components coupled together by and releasably coupled to a carrier. A crimping mechanism has an anvil with at least one tooth and a nest with at least one recess associated with the anvil. A feeding mechanism coupled to the frame adapted to feed crimpable components between the anvil and the nest. An actuator arm coupled to the frame is adapted to move the anvil and nest toward each other.

1 Claim, 5 Drawing Sheets

FIG 5
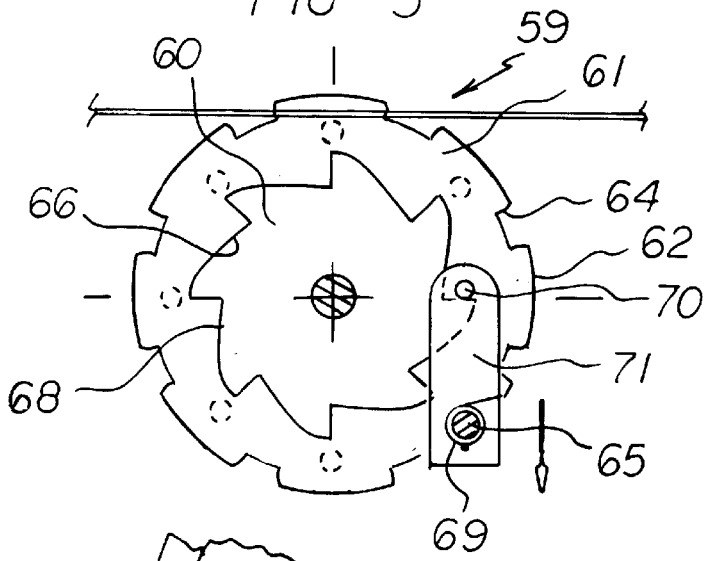
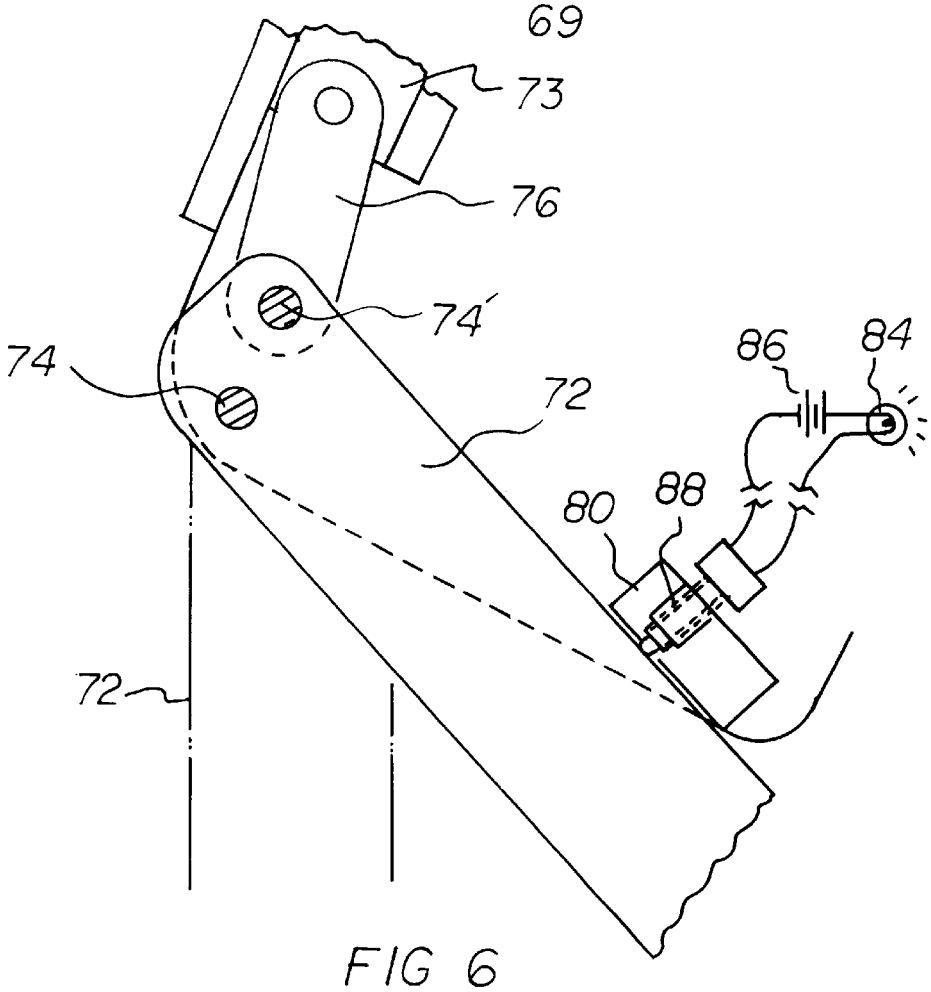
FIG 6

CRIMPING SYSTEM

BACKGROUND OF THE INVENTION

1. Field of the Invention

The present invention relates to a crimping system and more particularly pertains to effectively coupling fasteners and the like to ends of wires.

2. Description of the Prior Art

The use of coupling devices of known designs and configurations is known in the prior art. More specifically, coupling devices of known designs and configurations previously devised and utilized for the purpose of fastening through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,911,712 to Wustinger et al. discloses a crimping tool. U.S. Pat. No. 4,964,200 to Giesbrecht et al. discloses a lead making machine having improved crimping presses and actuating mechanism. U.S. Pat. No. 5,253,545 to Barrons et al. discloses an adjustable foot pedal for industrial sewing machines. U.S. Pat. No. 5,544,600 to Hunt discloses a knee control mechanism for industrial sewing. Lastly, U.S. Pat. No. 5,680,688 to Garner discloses a portable apparatus for affixing a lacer to a belt.

While these devices fulfill their respective, particular objectives and requirements, the aforementioned patents do not describe a crimping system that allows effectively coupling fasteners and the like to ends of wires.

In this respect, the crimping system according to the present invention substantially departs from the conventional concepts and designs of the prior art, and in doing so provides an apparatus primarily developed for the purpose of effectively coupling fasteners and the like to ends of wires.

Therefore, it can be appreciated that there exists a continuing need for a new and improved crimping system which can be used for effectively coupling fasteners and the like to ends of wires. In this regard, the present invention substantially fulfills this need.

SUMMARY OF THE INVENTION

In view of the foregoing disadvantages inherent in the known types of coupling devices of known designs and configurations now present in the prior art, the present invention provides an improved crimping system. As such, the general purpose of the present invention, which will be described subsequently in greater detail, is to provide a new and improved crimping system and method which has all the advantages of the prior art and none of the disadvantages.

To attain this, the present invention essentially comprises a wire. The wire is in a linear configuration. The wire is further adapted to be handheld by a user. The wire has a stripped free end. The free end is positionable in a crimpable component prior to their coupling. Provided next is a frame. The frame is comprised of a pair of side plates. The frame is also comprised of an upper end and a lower end. The frame is further comprised of a clamp. The clamp is adjacent to the lower end. The clamp is further adapted to be releasably coupled to the edge of a sturdy table. Next provided is a feeding mechanism. The feeding mechanism has a reel. The feeding mechanism also has a support bar and a carrier with fasteners. The carrier is selected from the class of crimpable components ran including tapes, metal straps and continuous molded strips. The fasteners are releasably coupled to the carrier. Each fastener is adapted to fit around the free end of the wire. The carrier is adapted to be wrapped around the reel until dispensed. The crimpable component is selected from the class of crimpable components including fasteners, terminals and connectors. A crimping mechanism is provided. The crimping mechanism has a pair of rotatable crimping dials. The pair of rotatable crimping dials includes a top dial and a bottom dial. The top dial has a generally cylindrical circumference. The top dial also has a plurality of anvils. The anvils extend from the circumference. The bottom dial also has a generally cylindrical circumference. The bottom dial further has a plurality of nests. The nests are adapted to mate with the anvils. The size of the nests is larger than the anvils. The size of the anvils is smaller than the fasteners. The top dial is operatively coupled adjacent to the bottom dial. The dials are separated by a gap during a rest state. The dials are adapted to move upwardly into operative association with the top dial. A feeding mechanism is provided next. The feeding mechanism is coupled to the housing adjacent to the gap between the dials. The feeding mechanism has guides. The feeding mechanism is adapted to uniformly feed crimpable components between the dials in a step and repeat manner. In this manner the feeding of fasteners to the gap in a sequential manner is assisted. Further provided is an arm. The arm has an upper end. The upper end is coupled by a pivot pin to the lower end of the frame. The upper end also includes a link. The link is operatively coupled to the arm. The link is pivotally coupled to the bottom dial. The arm further has a lower end. The lower end has a foot pad. The foot pad is adapted to receive the foot of a user. The arm further has a bumper pad. The retention pad is coupled to the lower end of the frame. In this manner when the user presses forwardly in an arcuate manner on the arm, the crimping mechanism is caused to couple a fastener to the wire when a crimpable component and wire end are located between the dials. The return action of the arm by gravity then activates the feeding mechanism to move the next subsequent crimpable component on the carrier into gap between the dials. The bumper pad is adapted to prevent the user from pressing the foot pad too hard or too far. Provided last is a light. The light has a power source. The light also has a push button switch. The push button switch is located adjacent to the bumper pad. In this manner, the light becomes illuminated when the arm is activated.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved crimping system which has all of the advantages of the prior art coupling devices of known designs and configurations and none of the disadvantages.

It is another object of the present invention to provide a new and improved crimping system which may be easily and efficiently manufactured and marketed.

It is a further object of the present invention to provide a new and improved crimping system which is small and of a light weight, durable and reliable constructions.

It is another object of the invention to conserve energy by eliminating the need for a motor when crimping components to stripped wire ends.

An even further object of the present invention is to provide a new and improved crimping system which is susceptible of a low cost of manufacture with regard to both materials and labor, and which accordingly is then susceptible of low prices of sale to the consuming public, thereby making such crimping system economically available to the buying public.

Even still another object of the present invention is to provide a crimping system for effectively coupling fasteners and the like to ends of wires.

Lastly, it is an object of the present invention to provide a new and improved crimping system comprising a frame. The frame is comprised of a plurality of plates with a clamp adjacent to the lower end. Applicator mechanisms are provided. The applicator mechanisms are adapted to feed crimpable components coupled together by a carrier. The crimpable components are coupled to the carrier. A crimping mechanism is also provided. The crimping mechanism has an anvil with at least one tooth and a next with at least one recess associated with the anvil. Further provided is a feeding mechanism. The feeding mechanism is coupled to the frame. The feeding mechanism is adapted to feed crimpable components between the anvil and the nest. Provided last is an actuator arm. The actuator arm is pivotally coupled to the frame. The actuator arm is further adapted to move the anvil and nest toward each other to cause the intended crimping.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross-sectional view of the feeding mechanism taken along 5—5 of FIG. 4.

FIG. 6 is a perspective illustration of the light and retention pad of the preferred embodiment of the present invention.

The same reference numerals refer to the same parts throughout the various Figures.

DESCRIPTION OF THE PREFERRED EMBODIMENT

Figure 1:
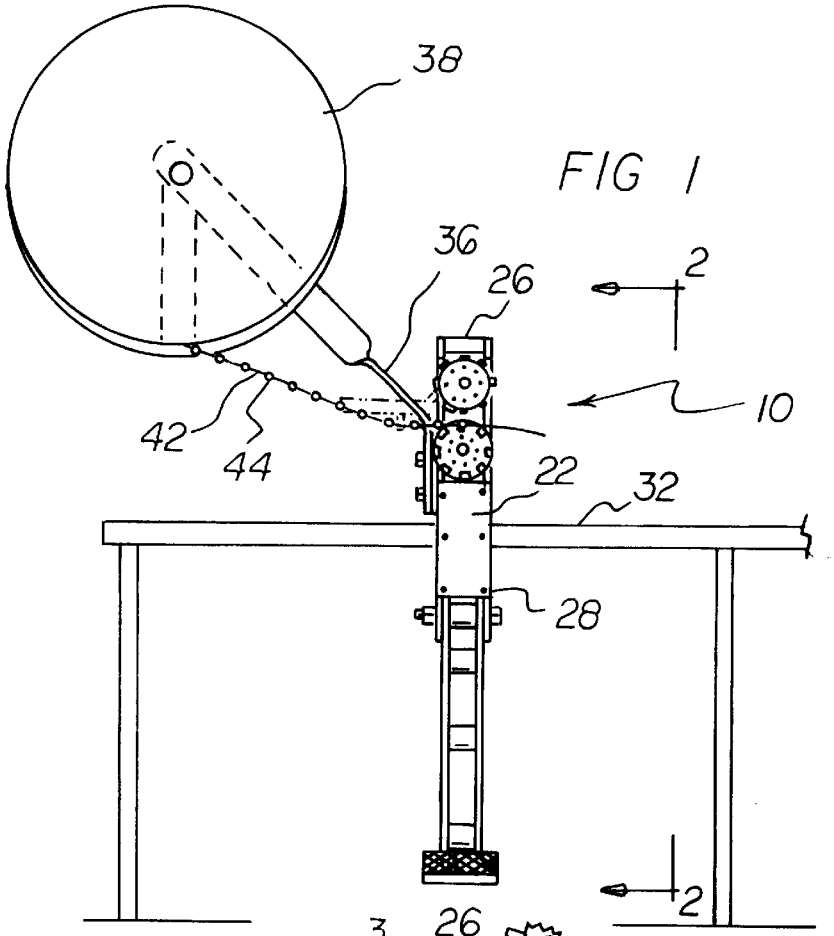
FIG. 1 is a perspective illustration of the preferred embodiment of the present invention.
Figure 2:
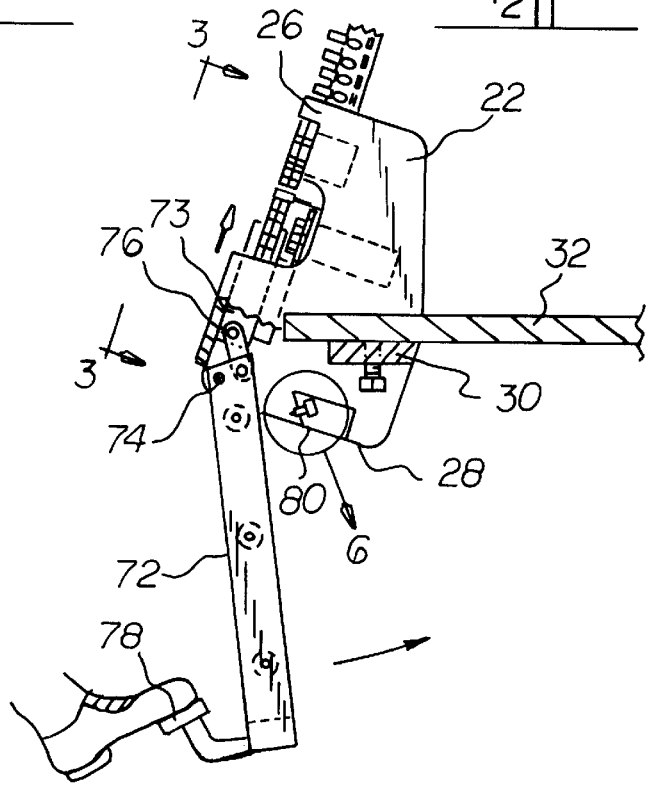
FIG. 2 is a cross sectional view of the present invention taken along line 2—2 of FIG. 1.
Figure 3:
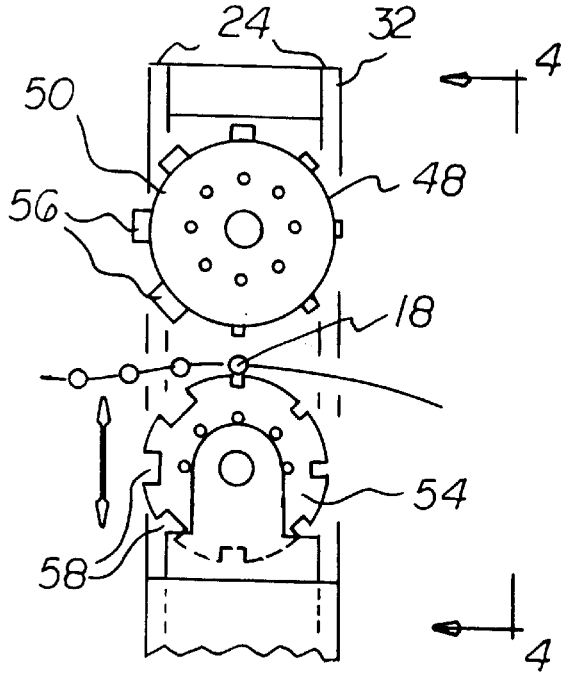
FIG. 3 is a top elevational view of the dials of the present invention taken along line 3—3 of FIG. 2.
Figure 4:
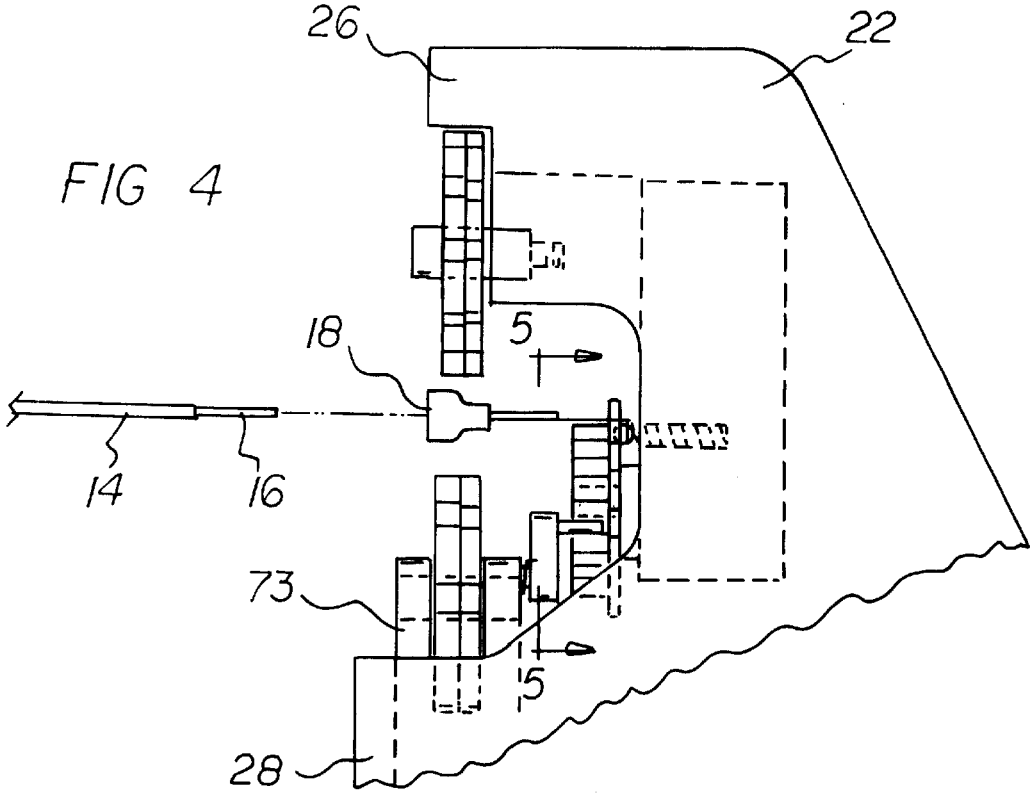
FIG. 4 is a side elevational view of the present invention taken along line 4—4 of FIG. 3.

With reference now to the drawings, and in particular to FIG. 1 thereof, the preferred embodiment of the new and improved crimping system embodying the principles and concepts of the present invention and generally designated by the reference numeral 10 will be described.

The present invention, the crimping system 10 is comprised of a plurality of components. Such components in their broadest context include a frame, a table clamp, an applicator, a crimping mechanism, a feeding mechanism and an actuator arm. Such components are individually configured and correlated with respect to each other so as to attain the desired objective.

First provided is a wire 14. The wire is in a linear configuration. The wire is further adapted to be handheld by a user. The wire has a stripped free end 16. The stripped free end is positionable in a crimpable component 18 prior to their coupling.

Provided next is a frame 22. The frame is comprised of a pair of side plates 24. The frame is also comprised of an upper end 26 and a lower end 28. The frame is further comprised of a clamp 30. The clamp is adjacent to the lower end. The clamp is further adapted to be releasably coupled to the edge of a sturdy table 32.

Next provided is a feeding mechanism 59. The feeding mechanism has a reel 38. The feeding mechanism also has a support bar 36 and a carrier 42 with crimpable components 44. The crimpable components are releasably coupled to the carrier. Each crimpable component is adapted to fit around the free end of the wire. The carrier is adapted to be wrapped around the reel until dispensed. The crimpable component is selected from the class of crimpable components including fasteners, terminals and connectors. The carrier is selected from the class of carriers including tapes, metal strips and continuous molded strips.

A crimping mechanism 48 is provided. The crimping mechanism has a pair of rotatable crimping dials. The pair of rotatable crimping dials includes a top dial 50 and a bottom dial 54. The top dial has a generally cylindrical circumference. The top dial also has a plurality of anvils 56. The anvils extend from the circumference. The bottom dial also has a generally cylindrical circumference. The bottom dial further has a plurality of nests 58. The nests are adapted to mate with the anvils. The size of the recesses is larger than the teeth. The size of the nests is smaller than the crimpable components. The top dial is operatively coupled adjacent to the bottom dial. The dials are separated by a gap during a rest state. The dials are adapted to move upwardly into operative association with the top dial. One dial has different size anvils while the other dial has different size nests. This allows the user to rotate the dials to allow for crimping different size components.

If the top ram action is used, the top dial will have a nest configuration. If the bottom ram action is used, as in the primary embodiment, the top dial will have the anvil configuration.

A feeding mechanism 59 with a ratchet 60 is provided next as shown in FIG. 5. The feeding mechanism is coupled to the ram 73 supporting the bottom dial 54 adjacent to the gap between the bottom dial and the index wheel 61. The feeding mechanism is adapted to uniformly feed coupling components between the dials in a step and repeat manner allowing the crimpable components only to be feed in a single uniform direction. The feeding mechanism is comprised of an outer diameter 62 with a plurality of generally rectangular teeth 64 and an inner diameter 66 with ratchet teeth 68. Rotation of the ratchet teeth 68 on the ratchet wheel 60 rotates the generally rectangular teeth to feed crimpable components. The feeding mechanism further has a ratchet bar 71 with a ratchet return spring 69 with a ratchet index pin 70 adapted to contact the ratchet teeth. Upward movement of the pin causes the pin to contact the next upward tooth and beyond. Downward movement begins to pull the tooth sequentially downwardly only after the dials have separated to advance the tape and fasteners in a step and repeat manner. Upward and downward movement of the pin is caused by the ratchet bar 71 coupling the index pin 70 and the ram 73 supporting the lower dial through ratchet pivot pin 65. Together the teeth and pin facilitate the advancement of the carrier with crimpable components and allow motion only in one direction. The generally rectangular teeth grip the carrier during advancement. The feeding mechanism enables a next crimpable component to be moved into place each cycle when the actuator arm 72 returns to its resting position so that the crimpable component may be crimped to the wire.

Further provided is an arm 72. The arm has an upper end. The upper end is coupled by a pivot pin 74' to the ram. The upper end also includes a link 76. The link is operatively coupled to the arm. The link is pivotally coupled to the ram. The arm further has a lower end. The lower end has a foot pad 78. The foot pad is adapted to receive the foot of the user. The arm further has a bumper pad 80. The bumper pad is coupled to the lower end of the frame 28. In this manner the action of the user pressing forwardly in an arcuate manner on the arm causes the crimping mechanism to couple a crimpable component to the wire when a crimpable component and the wire are located between the dials. In this manner the return movement of the actuator arm by gravity then activates the feeding mechanism to move the next subsequent crimpable component on the carrier into gap between the dials. The bumper pad is adapted to prevent the user from pressing the foot pad too hard or too far.

Not illustrated herein, but preferably provided, is a full cycle subassembly. Such full cycle subassembly includes components operatively coupled to the actuator arm whereby reserve movement of the actuator arm cannot begin until full forward movement of the actuator arm is completed. This precludes incomplete crimping and defective parts which might otherwise result. Full cycle subassemblies are common in the prior art.

Provided last is a light 84. The light has a power source 86. The light also has a push button switch 88. The push button switch is located adjacent to the bumper pad. In this manner, the light becomes illuminated when the arm is activated.

In an alternate embodiment of the present invention the link includes a pivotable plate 92. The pivotable plate has an associated tie rod 94. The bolt is operatively coupled to a jaw of the top dial. The action of the foot of a user draws the top dial downward to contact the crimpable component and the bottom dial in a scissors-like manner.

In a further alternate embodiment of the present invention the link includes an actuator arm 96. The actuator arm is operatively coupled to a ram of the top dial. The action of the foot of a user linearly draws the top dial down to contact the crimpable component and the bottom dial.

These alternative embodiments include an advancement mechanism for the carrier and crimpable components in any of a plurality of manners as is common in the prior art. See my prior patents U.S. Pat. Nos. 5,385,434; 5,440,799; 5,481,796; and 5,491,887.

Figure 7:
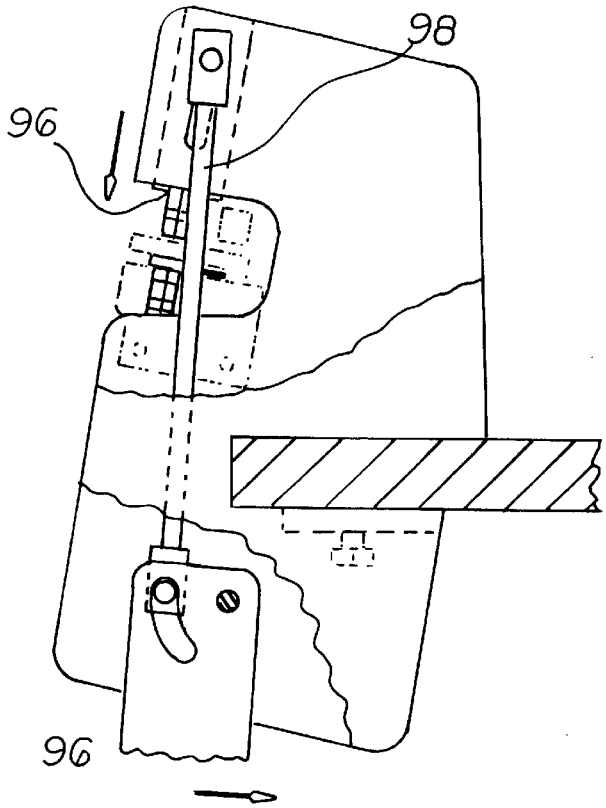
FIG. 7 is a perspective illustration of an alternative embodiment of the present invention.
Figure 8:
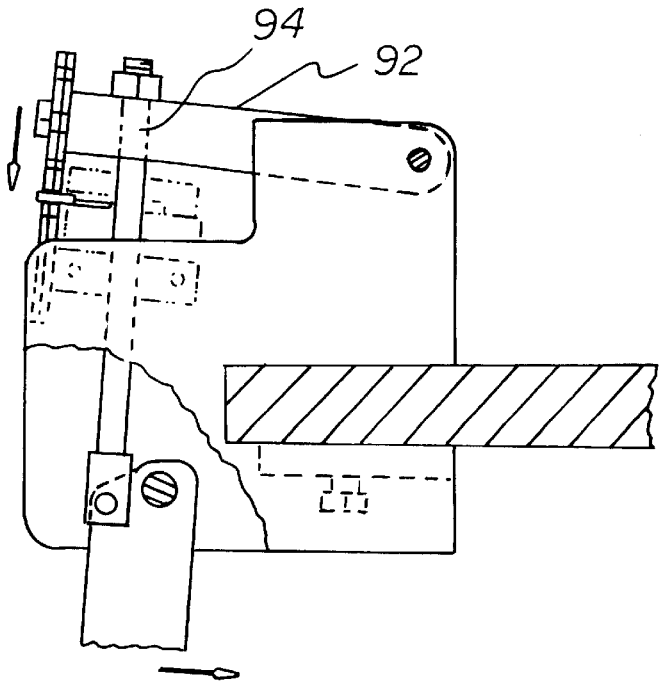
FIG. 8 is a perspective illustration of a further alternative embodiment of the present invention.
Figure 9:
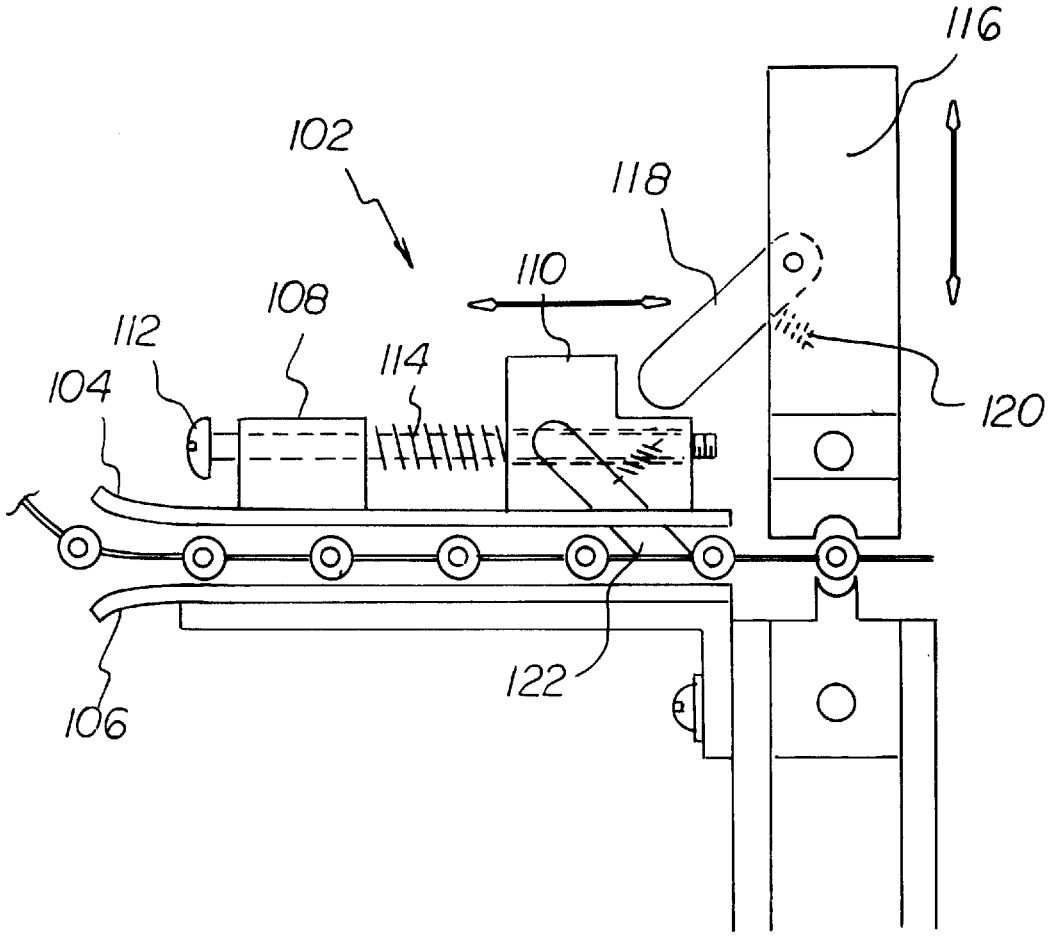
FIG. 9 is a side elevational view of a micro impact applicator for feeding crimpable components.

Shown in FIG. 9 is a micro impact application 102 which is adapted for use in feeding crimpable components to the crimping mechanism of the type shown in FIGS. 7 and 8. The applicator 102 includes an upper guide plate 104 and a lower guide plate 106 to feed crimpable components and their connector. A fixed block 108 with an unthreaded horizontal aperture is mounted to the upper surface of the upper plate. A feed slide 110 is slidably positioned on the upper surface of the upper plate. The feed slide has a threaded aperture axially aligned with the aperture of the block. A feed adjustment screw 110 is slidably received in the aperture of the block and adjustably secured to the aperture of the slide for allowing reciprocation of the slide. A coil spring 114 urges the slide away from the block. The ram 116, whether vertically shifting as in FIG. 7 or pivoting as in FIG. 8, has a pivotable impact actuation lever 118 urged outwardly by spring 120. Such actuation lever has a lower end positioned in an L-shaped shoulder in the slide to urge the slide toward the block during downward movement of the ram. Reverse or feeding movement of the slide is caused by the spring upon upward movement of the ram. A feed finger 122 with an upper end pivotably coupled to the slide has a lower end spring urged into contact with the crimpable connectors and carrier to feed the crimpable connectors in the step and repeat manner with the reciprocation of the jaw.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A crimping system for efficiently coupling terminals and connectors to ends of wires, the system comprising:

a wire in a linear configuration being hand held by a user with a stripped free end positionable in a crimpable component prior to their coupling;

a frame comprising of a pair of side plates and having an upper end and a lower end with a clamp adjacent to the lower end adapted to be releasably coupled to the edge of a sturdy work table;

a feeding mechanism having a reel and a support bar and a carrier with crimpable components releasably coupled to the carrier, each crimpable component being adapted to fit around the free end of the wire, the carrier being adapted to be wrapped around the reel until dispensed, the crimpable components being selected from the class of crimpable components including fasteners, terminals and connectors, with the carrier being selected from the class of carriers including tapes, metal strips and continuous molded strips;

a crimping mechanism having a pair of rotatable crimping dials including a top dial and a bottom dial, the top dial having a generally cylindrical circumference with a plurality of anvils extending from the circumference, the bottom dial also having a generally cylindrical circumference with a plurality of nests adapted to mate with the anvils, the size of the nests being larger than the anvils and smaller than the crimpable components, the top dial being operatively coupled adjacent to the bottom dial with the dials being separated by a gap during a rest state but adapted to move upwardly into operative association with the top dial;

a feeding mechanism coupled to the housing adjacent to the gap between the dials, the feeding mechanism having guides and being adapted to uniformly feed crimpable components between the dials in a step and repeat manner, the feeding mechanism further being coupled with respect to the dials of the crimping mechanism to assist the feeding of crimpable components to the gap in a sequential manner;

an actuator arm having an upper end being coupled by a pivot pin to the lower end of the frame, the upper end also including a link operatively coupled to the actuator arm and pivotally coupled to the bottom dial through the ram, the actuator arm further having a lower end, the lower end having a foot pad adapted to receive the foot of the user, the arm further having a bumper pad coupled to the lower end of the housing such that when the user presses forwardly in an arcuate manner on the arm the crimping mechanism is caused to couple a crimpable component to the wire when a crimpable component and wire end are located between the dials and whereby the return movement of the actuator arm by gravity then activates the feeding mechanism to move the next subsequent crimpable component on the tape into the gap between the dials, the bumper pad adapted to prevent the user from pressing the foot pad too hard or too far; and a full cycle indicator light with a power source and push button switch with the button switch located adjacent to the bumper pad such that when the actuator arm contacts the bottom switch the light becomes illuminated indicating a full cycle.

* * * * *